US008051782B2

(12) United States Patent
Nethken et al.

(10) Patent No.: US 8,051,782 B2
(45) Date of Patent: Nov. 8, 2011

(54) DESK AND DISPLAY STAND WITH HEIGHT AND DEPTH ADJUSTMENT

(75) Inventors: Jerry Lee Nethken, Gaston, OR (US); Steven E. Linder, Portland, OR (US); George W. Griffith, Portland, OR (US); Joseph L. Kumanchik, Vancouver, WA (US)

(73) Assignee: Anthro Corporation, Tualatin, OR (US)

( * ) Notice: Subject to any disclaimer, the term of this patent is extended or adjusted under 35 U.S.C. 154(b) by 424 days.

(21) Appl. No.: 12/277,604

(22) Filed: Nov. 25, 2008

(65) Prior Publication Data

US 2009/0133609 A1 May 28, 2009

Related U.S. Application Data

(60) Provisional application No. 60/989,978, filed on Nov. 25, 2007.

(51) Int. Cl.
*A47B 37/00* (2006.01)

(52) U.S. Cl. ..... 108/50.01; 312/223.3

(58) Field of Classification Search ..... 108/50.01, 108/50.02, 23, 50.11; 312/223.3, 223.6, 312/195; 297/217.3, 170, 172; 400/681, 400/682; 361/679.01, 679.05, 679.06, 379.2
See application file for complete search history.

(56) References Cited

U.S. PATENT DOCUMENTS

| | | | | |
|---|---|---|---|---|
| 4,779,922 | A | 10/1988 | Cooper | |
| 4,852,500 | A * | 8/1989 | Ryburg et al. | 108/50.01 |
| 5,101,736 | A | 4/1992 | Bommarito et al. | |
| 5,437,235 | A * | 8/1995 | Randolph | 312/223.3 |
| 5,845,587 | A * | 12/1998 | Ditonto | 108/50.01 |
| 5,909,934 | A * | 6/1999 | McGraw | 312/223.3 |
| 5,988,076 | A * | 11/1999 | Vander Park | 108/50.02 |
| 6,296,408 | B1 | 10/2001 | Larkin et al. | |
| 6,712,008 | B1 * | 3/2004 | Habenicht et al. | 108/50.01 |
| 7,640,866 | B1 * | 1/2010 | Schermerhorn | 108/50.02 |
| 7,721,658 | B2 * | 5/2010 | Seeley et al. | 108/50.01 |
| 7,823,973 | B2 * | 11/2010 | Dragusin | 108/50.01 |
| 2002/0020329 | A1 * | 2/2002 | Kowalski | 108/50.01 |
| 2005/0022699 | A1 * | 2/2005 | Goza | 108/50.01 |
| 2005/0217540 | A1 * | 10/2005 | Novak | 108/50.01 |
| 2006/0065166 | A1 * | 3/2006 | Chi et al. | 108/50.01 |

OTHER PUBLICATIONS

AFC Industries, Inc., Ergo Tier Deluxe, 1 page, http://www.afcindustries.com/ergo_delux_anim.htm, archived at www.archive.org Dec. 24, 2005.

AFC Industries, Inc., Engineering Drawing of DXET-6640-01, 1 page, archived at www.archive.org Dec. 24, 2005.

* cited by examiner

*Primary Examiner* — Jose V Chen
(74) *Attorney, Agent, or Firm* — Stoel Rives LLP

(57) ABSTRACT

An ergonomic desk includes an adjustable display stand supported on a table or other support platform of the desk. The display stand is adapted to support one or more display monitors thereon and to provide depth and height adjustment for the display monitors via electronic controls. The height and tilt of the table may also be adjusted using electronic controls.

20 Claims, 12 Drawing Sheets

DESK AND DISPLAY STAND WITH HEIGHT AND DEPTH ADJUSTMENT

RELATED APPLICATION

This application claims the benefit under 35 U.S.C. §119 (e) from U.S. Provisional Patent Application No. 60/989,978, filed Nov. 25, 2007, which is incorporated herein by reference.

TECHNICAL FIELD

The field of the present disclosure relates to adjustable desktop stands for display devices such as electronic image displays and computer monitors, and to desks, tables, and the like incorporating such stands.

BACKGROUND

A prior art desk designed for ergonomic viewing of electronic displays is sold under the trademark CARL'S TABLE®-2003 Model (hereinafter "CT03") by Anthro Corporation, the assignee of the present invention. FIG. 1 is a photograph of the CT03 desk 10. With reference to FIG. 1, the CT03 desk 10 includes first and second table sections 12, 14 supported on a pair of telescoping legs 16 that are driven by a lift motor for changing the height of surfaces 12*a*, 14*a* of first and second tables above the floor. A first control switch 22 allows a user to raise and lower the table surfaces 12*a*, 14*a* to a preferred seating height or higher, to a standing position. The table surfaces 12*a*, 14*a* extend laterally from the user's position. The first table surface 12*a* is positioned in between the second table surface 14*a* and the user's position. The display monitors (not shown) are mounted on display stands 24 attached to the second table surface 14*a*, while the first table surface 12*a* remains open for use as a work surface or as a platform for a keyboard. The first and second table sections 12, 14 are rigidly coupled together and motor driven for rotation relative to the legs 16 about a horizontal axis extending side-to-side, for thereby adjusting the tilt of the first and second table surfaces 12*a*, 14*a* in tandem. In response to actuation of a second control switch 26, the table sections 12, 14 are driven for rotation in synchronization with an adjustment of the telescoping legs 16 so that the tilt of first table surface 12*a* is adjusted without substantially changing the height position of a proximal edge 28 of the first table surface 12*a* nearest the user. In this manner, the angle of the first table surface 12*a* can be adjusted without requiring a user to change the height of his or her chair to accommodate the movement of the first table section 12.

In the CT03 desk 10, each of the display stands 24 includes a pole 30 fixedly attached to the second table surface 14*a* and a pair of swing arms 32 mounted extending laterally from boom 30. Each swing arm 32 can each be articulated for adjusting a depth position of the display mounted thereon (not shown). The swing arms 32 are also movable vertically along pole 30 to adjust the height of the display monitors. To prevent inadvertent movement of the display monitors when the second table surface 14*a* is tilted, screws in shoulder and elbow joints 34 of the swing arms 32 are tightened once the displays are positioned where desired.

Incorporated herein by reference for purposes of background are U.S. Patent Application Publication Nos. US 2006/0075933 A1 and US 2006/0244717 A1. US 2006/0075933 A1 describes a supporting arrangement for a presentation device such as an image display monitor, wherein a supporting arrangement and a work surface are coupled for relative angular movement for adjusting both a tilt of the work surface and a viewing angle of the presentation device; and US 2006/0244717 A1 describes a system for automatically adjusting workplace illumination in response to changes in the intensity of images displayed on a computer display monitor.

U.S. Patent No. 6,296,408 of Larkin et al. describes a workstation having a motorized support for a computer monitor that is automatically controlled by a computer controller programmed to continuously make imperceptible adjustments to a chair position, a footrest position, a keyboard position, and/or a monitor position to prevent worker fatigue and/or repetitive stress disorders. The Larkin et al. mechanism for moving a monitor is disclosed as a height adjuster secured to a non-rotatable work table with a vertically extending support coupled to the height adjuster. A monitor distance adjuster is secured to the support and horizontally moves a monitor support that extends through the monitor distance adjuster.

The present inventors have recognized a need for an improved desk and desktop display stand enabling ergonomic configuration.

DETAILED DESCRIPTION OF PREFERRED EMBODIMENTS

Figure 2:
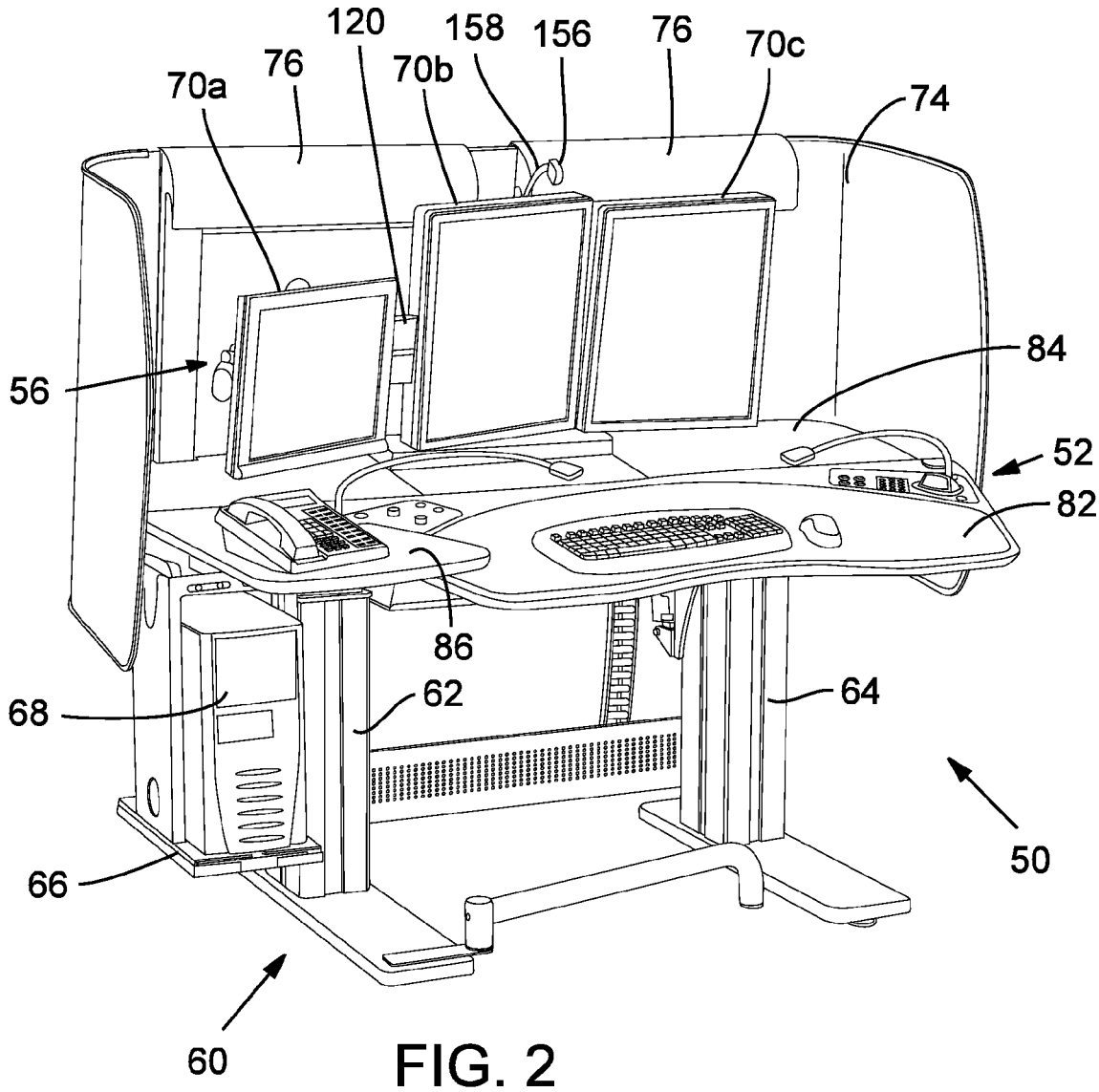
FIG. 2 is a front pictorial view of a desk and display stand in accordance with an embodiment with a computer and display monitors installed.
Figure 2A:
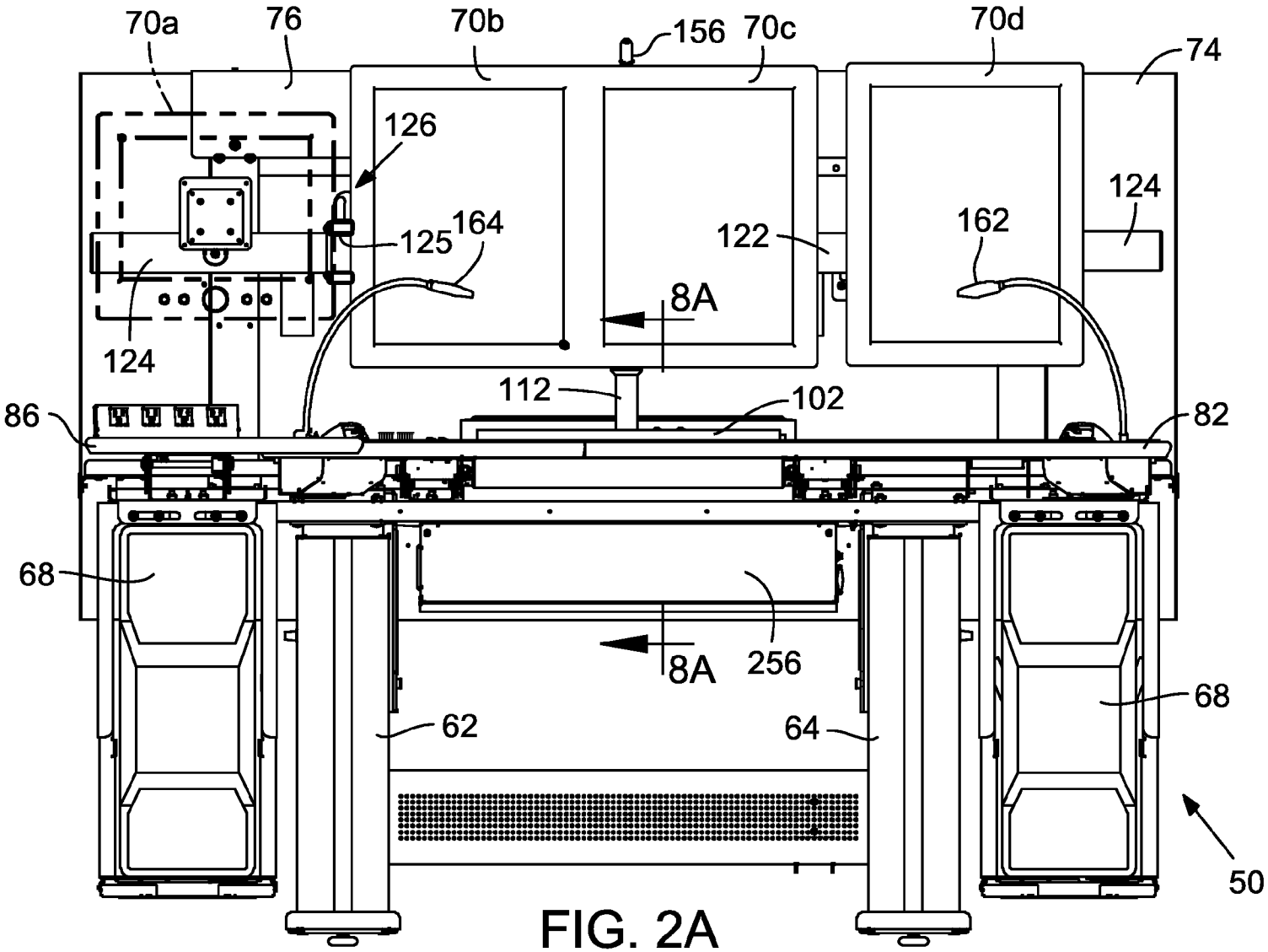
FIG. 2A is a front elevation view of the desk and display stand of FIG. 2 in an alternate configuration with two computers and three display monitors installed.
Figure 3:
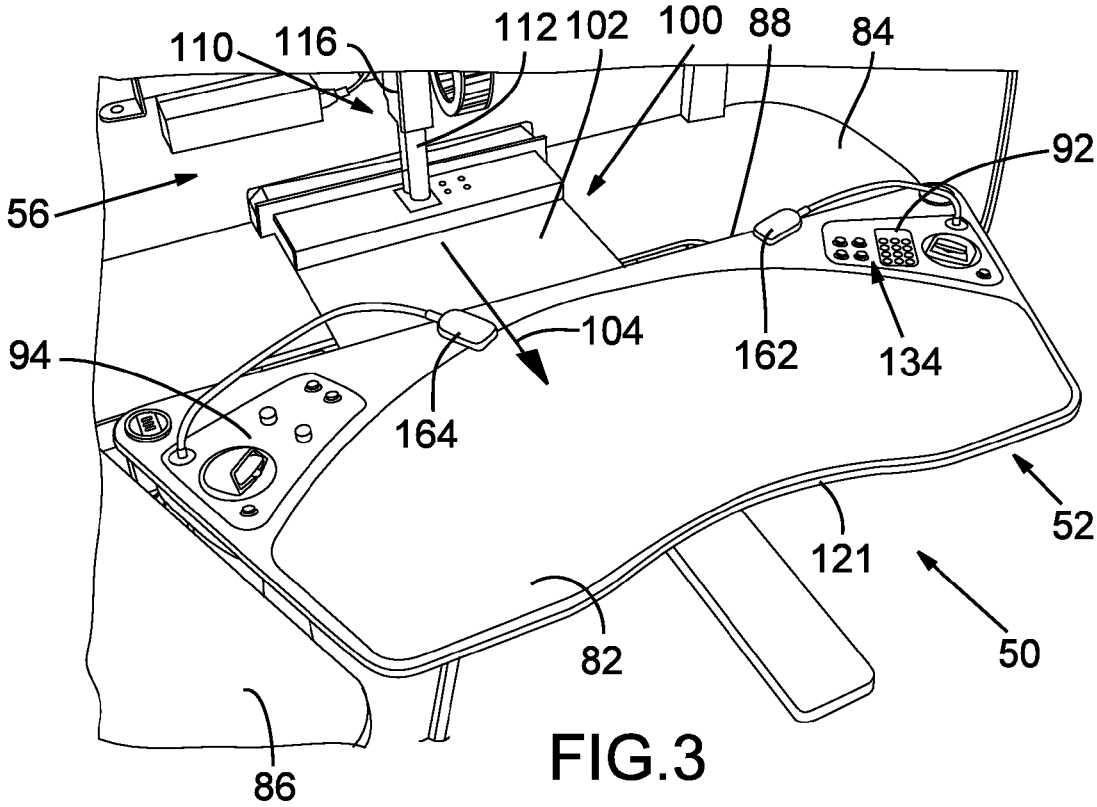
FIG. 3 is a top view of the desk and display stand of FIG. 2 showing detail of first and second table sections and illustrating the locations of first and second control panels and task lights mounted on the first table section near a rear margin thereof.

With reference to FIGS. 2, 2A, and 3, a desk 50 in accordance with a first embodiment includes a table unit 52 and display stand 56 supported on a base assembly 60 including first and second telescoping legs 62, 64. Legs 62 and 64 include leg drive motors (not shown) for adjusting a height of table unit 52 and the display stand 56 mounted thereon. A CPU holder 66 is suspended from table unit 52 to hold a computer 68. Display monitors 70*a*, 70*b*, 70*c*, and 70*d* (hereinafter collectively "display monitors 70") are shown in FIG. 2 mounted to display stand 56. A privacy panel 74 extends along the rear of table unit 52 behind display monitors 70. A set of backlights 76 are mounted adjacent a front surface of privacy panel 74 to provide backlighting illumination behind display monitors 70 for enhancing the visibility of images displayed on display monitors 70.

Figure 1:
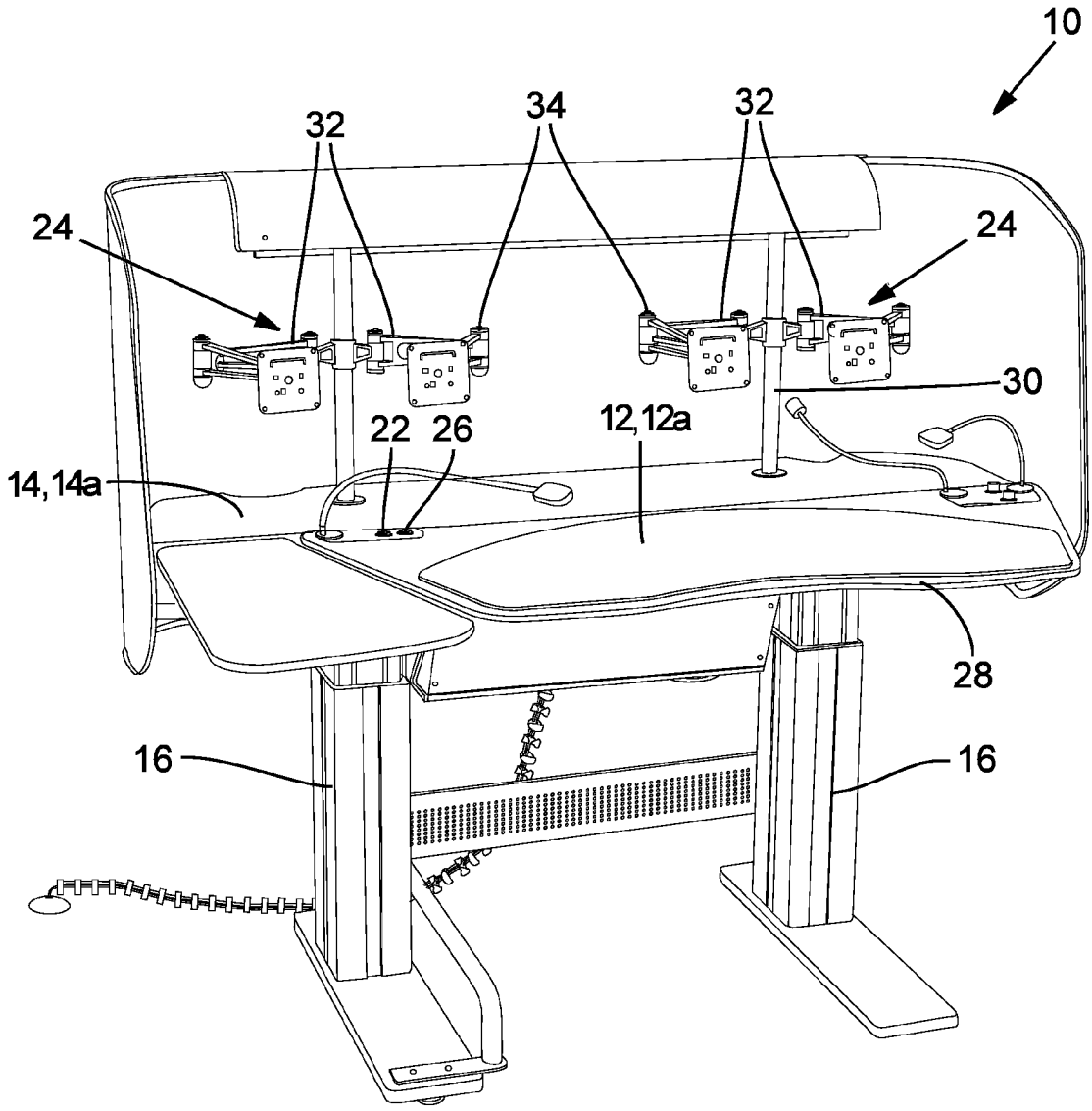
FIG. 1 (PRIOR ART)
FIG. 1 is an illustration of a desk and display stand in accordance with the prior art.

Table unit 52 includes first, second, and third table sections 82, 84, and 86. Second table section 84 is located along a rear edge 88 of first table section 82. Display stand 56 is mounted on second table section 84 as further described below with reference to FIGS. 3-5, and 8. First and second table sections 82 and 84 are preferably coupled together and rotatable in tandem to adjust a tilt thereof, in the manner of the prior art CT03 desk described above with reference to FIG. 1. In an alternative embodiment (not shown), first and second table sections 82 and 84 may be independently rotatable relative to legs 62, 64 or coupled for rotation about spaced-apart first and second axes, respectively, in the manner described in publication No. US 2006/0075933 A1. Third table section 86 remains level to provide a convenient non-tilting surface for items such as beverages and telephones, for example. First and second control panels 92 and 94 are located in the respective rear right and rear left corners of first table section 82 or in any other convenient location. Control panels 92 and 94 are described below with reference to FIGS. 6 and 7.

Figure 4:
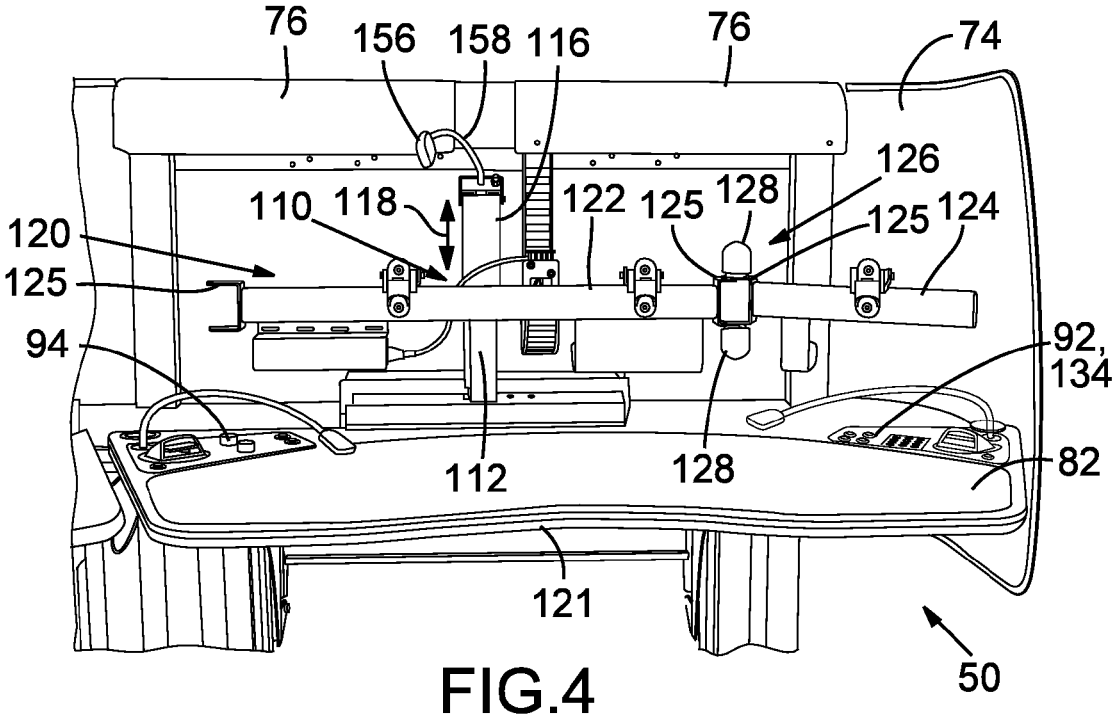
FIG. 4 is a enlarged front view of the table surfaces and display stand of FIG. 2 with display monitors omitted to show detail of the display stand.
Figure 5:
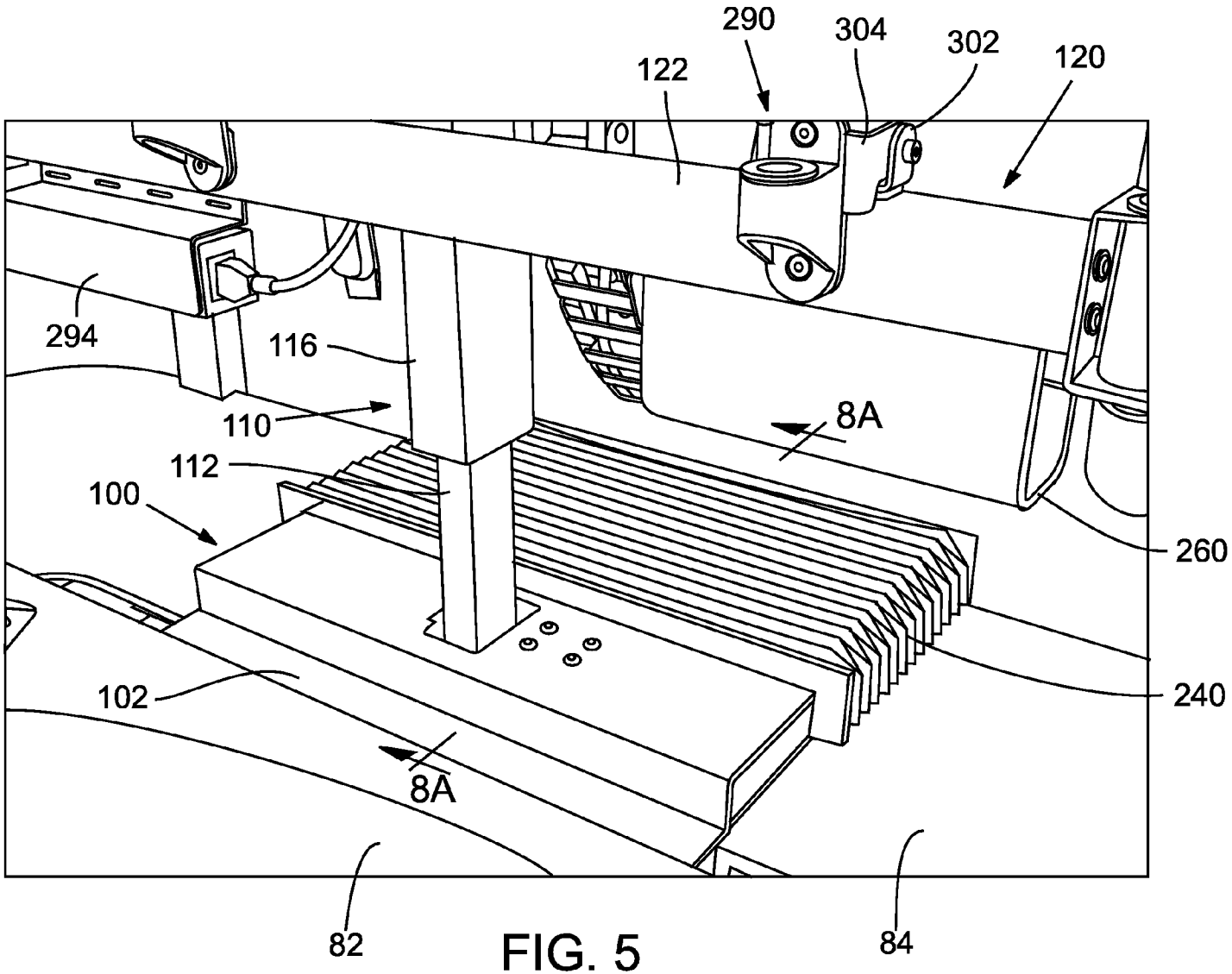
FIG. 5 is an enlarged front right view of the display stand of FIG. 2.

With reference to FIGS. 3-5 display stand 56 includes a sled assembly 100 having a sled 102 slidably mounted to second table section 84 for sliding movement along a first path extending in the direction of arrow 104 toward a user of desk 50 and at least partly under first table section 82. In an alternative embodiment, sled assembly 100 may be supported on another part of desk 50 different from second table section 84, such as first table section 82. In another alternative embodiment (not shown) first and second table sections 82 and 84 may be combined as a single table having an opening for accommodating sled assembly 100. Thus, part or all of table unit 52 may provide a support platform for display stand 56 and, in some embodiments, may also provide a work surface or keyboard surface. Sled 102 may preferably extend at least partly under the support platform or, in some embodiments, may extend within or into a cavity in the support platform and under a top surface of the support platform—which shall also be considered to be "under" the support platform for purposes of the present application. Sled 102 may also be movably mounted to a support platform other than slidably, for example, on a rack and pinion mechanism (not shown) or other suitable manner.

Display stand 56 further includes a mast 110 supported on the sled 102 and extending upwardly from sled assembly 100 through an elongate opening 202 (FIG. 8) in table unit 52. Mast 110 includes a base member 112 attached to sled 102 and movable therewith along first path 104 within opening 202. Mast 110 further includes a moving member 116 operably engaged with base member 112 and movable upwardly relative to base member 112 along a second path 118 extending upwardly and generally perpendicular or transverse to first path 104. Moving member 116 supports thereon a display mount assembly 120 that is adapted for mounting one or more display monitors 70 thereon, for thereby suspending display monitors 70 above second table unit 52. In the embodiment shown, mast 110 includes telescoping base and moving members 112, 116. However, in other embodiments (not shown) mast 110 may be configured differently for accomplishing a height adjustment.

Figure 8:
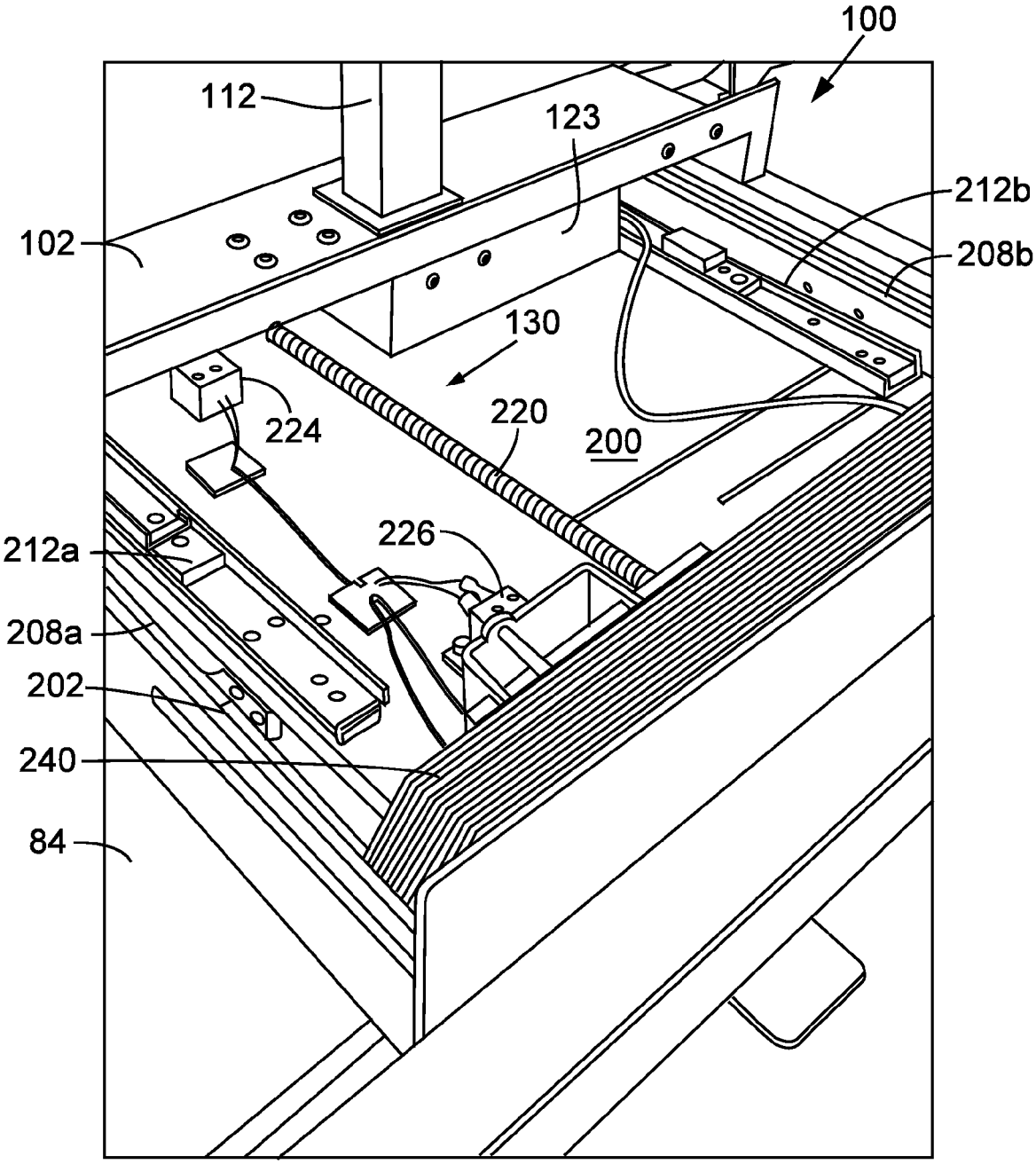
FIG. 8 is a top rear view of the display stand of FIGS. 2-5 with a collapsible accordion cover of the display stand retracted to reveal glides and a drive screw of a sled portion of the display stand in accordance with one embodiment.
Figure 8A:
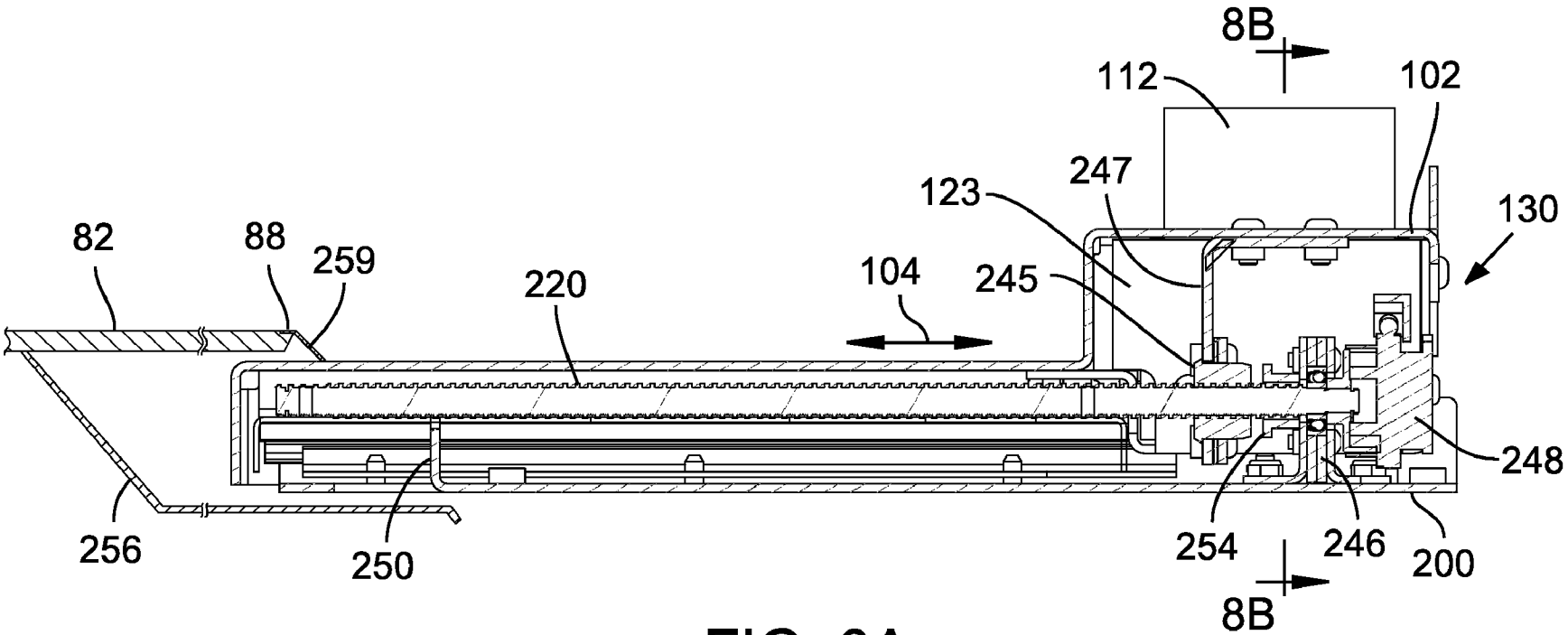
FIG. 8A is a sectional view taken along lines 8A-8A of FIGS. 2A and 5, showing sled drive details according to another embodiment.

Sled assembly 100 is driven for sliding movement of sled 102 toward and away from a front edge 121 of first table section 82 and a user of desk 50 by a sled drive 130 (FIGS. 8 and 8A). The sled drive 130 may, thus, adjust a depth position of the display mounting assembly 120 supported on the sled, as further described below with reference to FIG. 8. A mast drive including a mast drive motor 123 (FIG. 8B) is attached to the desk 50, and preferably supported on the sled 102 and operably coupled to mast 110 for driving moving member 116 relative to base member 112 and sled 102 along a second path 118, thereby adjusting a height of display mount assembly 120 relative to table assembly 52. One suitable mast 110 with an integrated linear actuator mast drive is the Model DL1 DESKLIFT™ lifting column offered by Linak A/S of Gudrup, Denmark.

Display mount assembly 120 includes a boom 122 and one or more boom extension arms 124 (FIGS. 2A, 4, and 11) extending laterally from mast 110. Boom extension arms 124 may be coupled to an end of boom 122 via shackles 125 extending from the mating ends of the boom 122 and boom extension arm 124. The shackles 125 are joined by a clevis pin forming part of an adjustable friction joint 126 for articulation of a distal end of boom extension arms 124 forward and aft relative to boom 122 about a pivot axis extending in a generally vertical direction through friction joint 126. Friction joint 126 includes a friction mechanism having a pair of knobs 128 that may be tightened and loosened to adjust the tension and holding power of the friction joint 126 to thereby maintain the position of a display monitor mounted to boom extension arm 124 during normal adjustment of table unit 52 and display stand 56. Friction joint 126 may also serve as a passive safety feature that allows boom extension arm 124 to rotate in the event that the boom extension arm 124 or a display monitor mounted thereto encounters an obstacle during adjustment of the depth of display stand 56. In an alternative embodiment (not shown), boom 122 could be divided into sections and a friction joint similar to friction joint 126 could be located at the place where the boom sections are coupled to mast 110 to provide a similar adjustability and passive safety feature for all of display monitors mounted to boom 122, rather than just for the display monitor mounted to boom extension 124.

Figure 6:
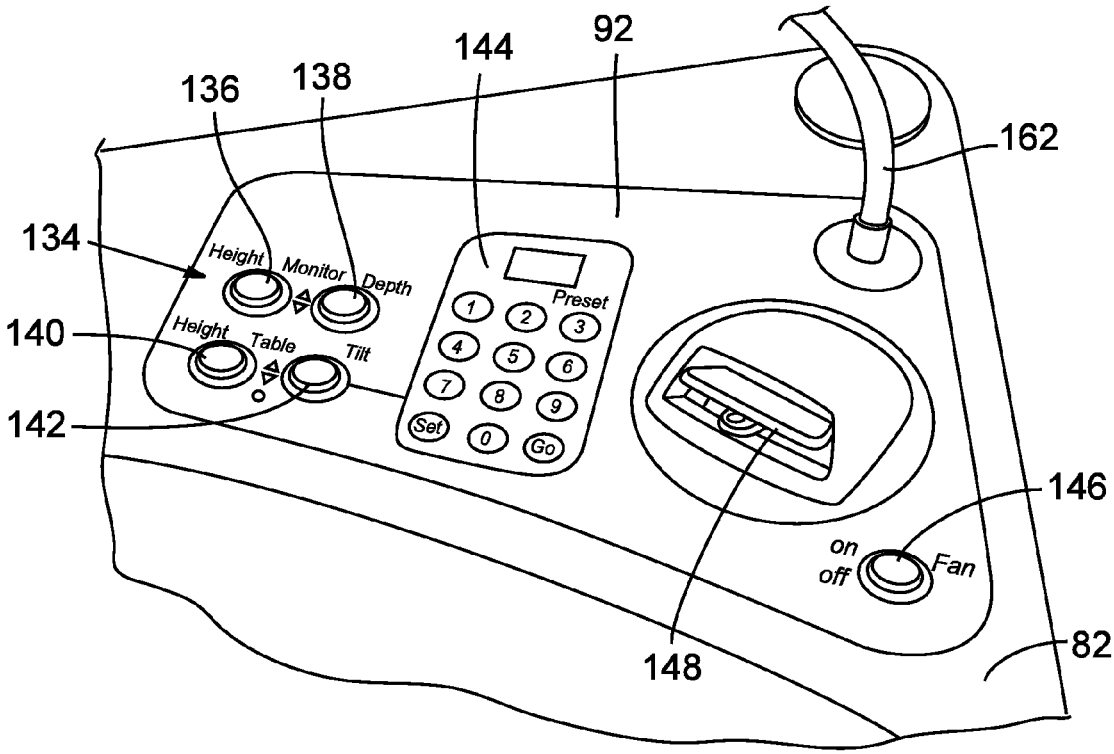
FIG. 6 is an enlarged pictorial view of the first control panel of FIG. 3, showing detail of the desk height and tilt controls and the monitor height and depth controls.

With reference to FIGS. 3 and 6, a controller of display stand 56 (FIG. 3) includes a user interface 134 comprising a pair of rocker switches 136, 138 located on first control panel 92 for actuating the respective mast drive motor 123 and sled drive 130. Controller and user interface 134 thereby allow a user to adjust the height and depth positions of the display mounting assembly 120 to a desired position relative to table unit 52. A second set of rocker switches 140, 142 are provided on first control panel 92 for controlling the respective height of table unit 52 and tilt of first table section 82 (which also concurrently adjusts the height of table unit 52 so as to maintain the height of front edge 121 of first table section 82, as described above). A keypad 144 is provided for interfacing with the controller and a memory thereof to store and recall up to 99 different user-defined table height and tilt settings for automatically returning the table unit 52 to a predefined position. In some embodiments, keypad 144 may also be utilized to store and recall multiple different user-defined display monitor height and depth settings for returning display stand 56 and display mounting assembly 120 to a predefined position. In yet another embodiment, user-defined settings defining the positions of both the display stand 56 and table unit 52 may be stored in memory and later recalled using keypad 144 for thereby simultaneously adjusting the position of display monitors 70 and table unit 52 to their predefined positions. User presets may facilitate convenient use of desk 50 by different users and for different purposes and user seating or standing positions. A fan switch 146 on first control panel 92 switches a fan on and off. The fan includes a manually-adjustable louver assembly 148 for directing air blown by the fan as desired by a user.

Figure 7:
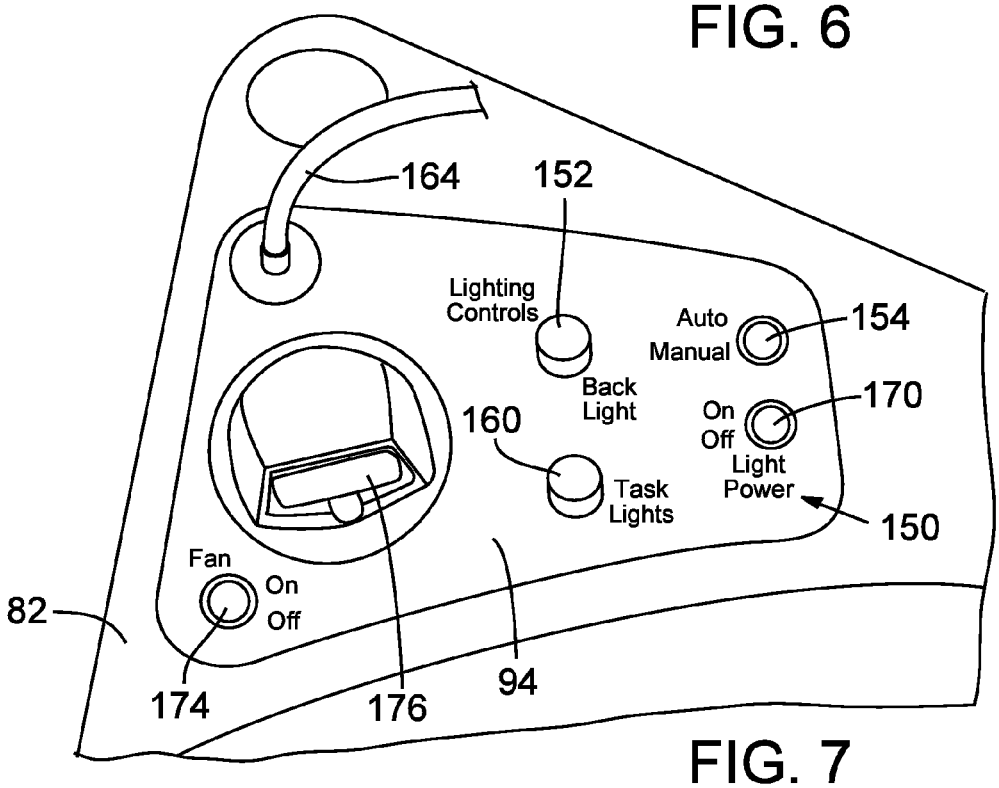
FIG. 7 is an enlarged pictorial view of the second control panel of FIG. 3, showing detail of lighting controls.

With reference to FIG. 7, second control panel 94 includes lighting controls 150, including a backlight dimming dial 152 for manually adjusting the intensity setting of backlights 76 and an auto/manual toggle switch 154 for switching between a manual control mode and an automatic lighting control mode. In the automatic lighting control mode, the intensity of backlights 76 is automatically adjusted in response to changes in the brightness of images displayed on display monitors 70, as sensed by a photosensor 156 (FIGS. 2 and 4) or by another means, such as monitoring of the display input signals. A task light dial 160 is also located on second control panel 94 for adjusting the intensity of a pair of task lights 162, 164. A master lighting power switch 170 is also provided for switching the task lights 162, 164 and backlights 76 on and off. Finally a second fan is switched on and off by a second fan switch 174 on second control panel 94, and a louver assembly 176 is manually adjustable to direct air blown by the fan.

Turning again to FIGS. 2 and 4, photosensor 156 is mounted to the top of moving member 116 of mast 110 so that photosensor 156 moves in tandem with adjustments to the height and depth of display monitors 70, thereby avoiding changes in the position of photosensor 156 relative to display monitors 70. Photosensor 156 may be supported on a flexible neck 158 that reaches from mast 110 to the front of display monitors 70. Flexible neck 158 may be manipulated to move photosensor 156 fore, aft, up, down, left, and right relative to display mount assembly 120 to thereby position photosensor 156 at a desired position during setup or later use of desk 50, for example to accommodate different sizes and types of display monitors 70. Maintaining the spacing and relative positioning of photosensor 156 relative to display monitors 70 during subsequent adjustment of the height and depth of the display stand 56 may provide improved consistency and convenience in automatic control of backlights 76.

Figure 8B:
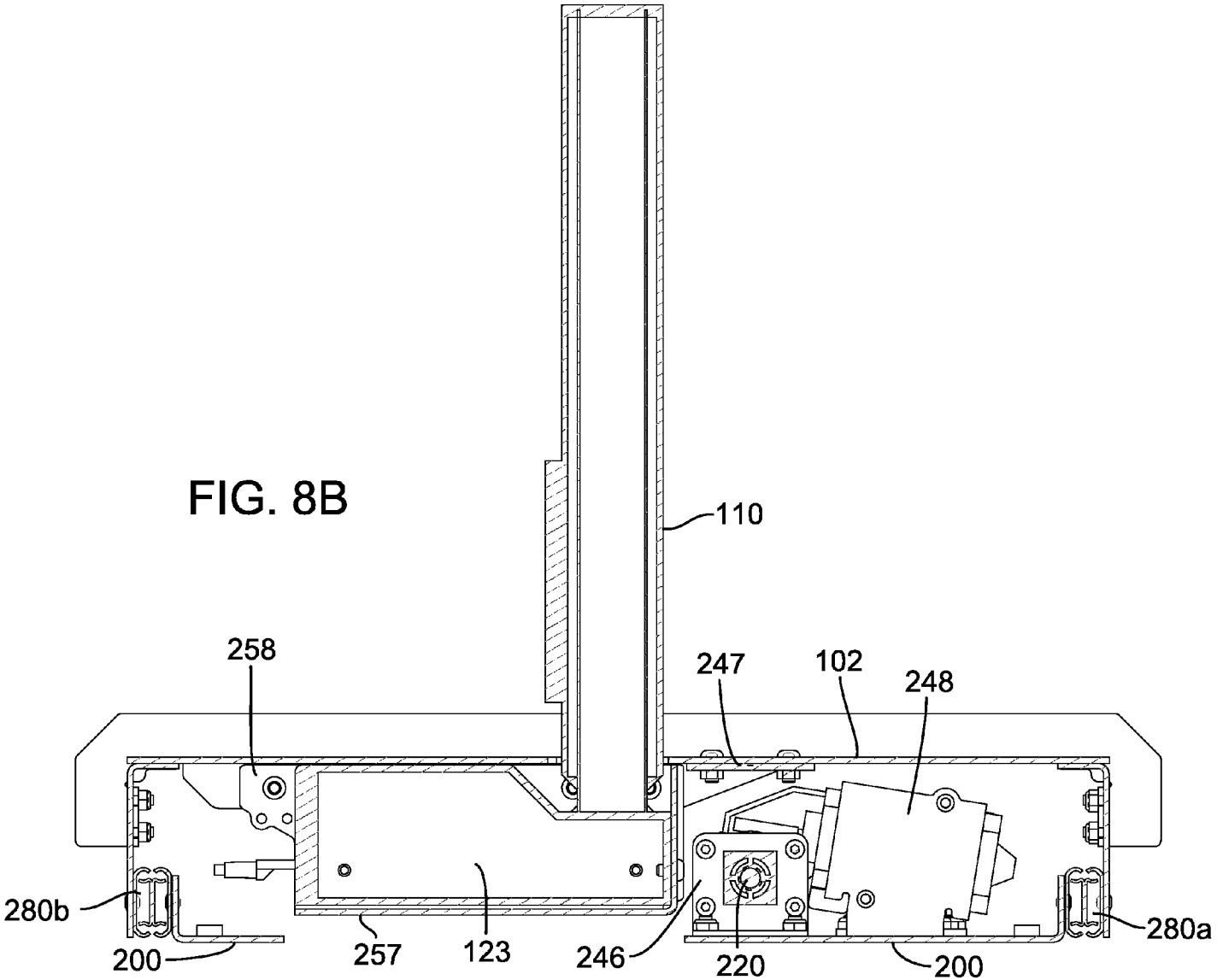
FIG. 8B is a sectional view taken along lines 8B-8B of FIG. 8A, and showing further details of the display stand drive components.
Figure 9:
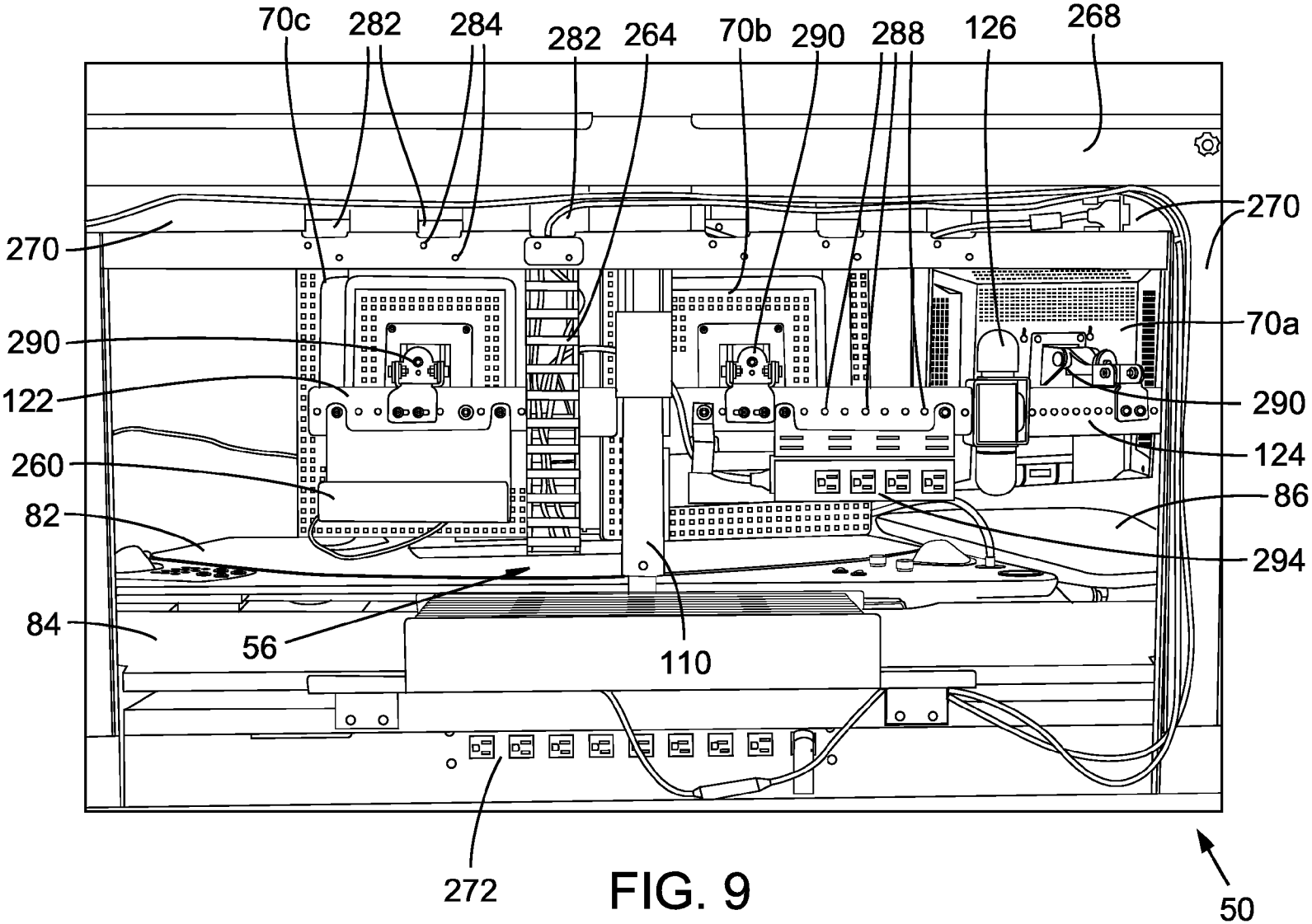
FIG. 9 is a rear view of the desk of FIGS. 2-5 with a privacy panel of the desk removed to show detail of the rear side of the display stand and cable management features of a rear frame portion of the desk.

With reference to FIGS. 8, 8A, and 8B, sled assembly 100 includes a sled tray 200 fixedly mounted within or adjacent an opening 202 in second table section 84. Sled 102 is slidably mounted to sled tray 200 via first and second sets of glides or forwardly-extending telescoping slides 208*a*, 208*b*, 212*a*, 212*b*, such as ball-bearing extension slides of the kind commonly used with desk drawers, for example. The first set of slides 208*a*, 208*b* is oriented vertically for supporting the weight of sled 102, mast 110 and display monitors 70. The second set of slides 212*a*, 212*b* is oriented horizontally for providing torsional stability, as discussed below. Sled drive 130 is preferably mounted above sled tray 200 and includes a drive screw 220 extending in direction 104 (FIG. 2) beneath sled 102 and rotatably supported on sled tray 200 via a shaft support bearing 246. A spindle nut 245 (FIG. 8A) is rigidly coupled to sled 102 via mounting bracket 247 and threaded onto drive screw 220 for movement of sled 102 therealong in response to rotation of drive screw 220 by a sled drive motor 248 (FIG. 8A) of sled drive 130. Sled tray 200, sled 102, and slides 208, 212 may be formed of steel or another strong, durable material capable of supporting the weight of display stand 56 and display monitors 70.

Sled drive motor 248 may be electronically controlled by rocker switch 138 (FIG. 6) of the controller independently of other motor-driven adjustments. In some embodiments, sled drive motor 48 may also be electronically controlled by keypad 144, or may be controlled in concert with mast drive motor 123 and/or motor-driven adjustment features of table unit 52. In the embodiment of FIG. 8, a pair of limit switches 224, 226 provide feedback to the sled drive motor controller for limiting the forward and rearward travel of sled 102. One suitable sled drive is a Model DB5 linear actuator offered by Linak A/S of Guderup, Denmark.

In an alternate embodiment, illustrated in FIG. 8A, front and rear physical stops 250, 254 are employed to limit the range of movement of sled 102. At system startup, the sled motor controller may "home" the sled 102 by moving the sled 102 to one or both of its forward and/or rearward physical limits of travel established by stops 250, 254, thereby causing a spike in the electrical current drawn by the sled drive motor 248. When spindle nut 245 contacts rear stop 254, the sled motor controller identifies a zero position for sled 102, in other words a known position for sled 102 along drive screw 220. The controller may thereafter limit the forward and rearward travel of sled 102 relative to the zero position, for example, by counting the number of turns of sled motor 248, controlling the amount of time the sled motor 248 is operated, or by any other suitable manner. Preferably, the sled motor controller stores the position of sled 102 in memory and uses the position of sled 102 to determine soft stops, that is, calculated or derived limits to the travel for sled 102 so sled 102 does not actually reach the physical limits of its travel after the initial homing operation.

Due to space constraints, drive screw 220 of sled drive 130 is located laterally off-center in the embodiment shown, to the right side of the mast 110 (as viewed from the user's seating position) to accommodate mast drive motor 123. Mast drive motor 123 is attached to an underside of sled 102 via a mast lift housing 257 suspended below and connected to sled 102 via a lift housing bracket 258. The second set of slides 212*a*, 212*b* provide torsional rigidity and counteract torque generated about a vertical axis by the moment arm between the coupling point of sled drive 130 to sled 102 and the center of mass of sled 102 and mast 110. A collapsible accordion cover 240 (shown retracted in FIG. 8; see also FIG. 5) extends between the rear margin of sled 102 and a back panel of sled tray 200 to cover sled drive 130. Sled tray 200 provides support for slides 208*a*, 208*b*, 212*a*, 212*b* and sled drive 130. A sled guard 256 extends below table unit 52 around and forward of the path 104 of movement of sled 102 to prevent sled 102 from hitting a user's knees when sled 102 is moved. A rubber wiper flap 259 extends downwardly from rear margin 88 (FIG. 3) of first table section 82 and against a top surface of sled 102 to prevent debris that may fall onto the top of sled 102 from inadvertently dropping under first table section 82 and into sled guard 256.

Referring now to FIGS. 4 and 9-11, one or more cable management trays 260 or other cable management guides of different sizes and configurations may be mounted to boom 122 and boom extensions 124 to help organize, collect and guide cables extending between display monitors 70 and CPU 68 (FIG. 2), power outlets 272, and other locations. A flexible cable chain 264 comprised of a series of hollow plastic links provide additional cable management for cables extending between display stand 56 and a rear frame 268 of desk 50. Rear frame 268 includes a cable raceway 270 around its perimeter between rear frame 268 and removable privacy panel 74 (FIG. 2), through which electrical cables may be routed from cable chain 264 to CPU 68 or power strip 272 located below a rear portion of second table section 84, or to other devices or services in other locations. Rear frame 268 includes a series of spaced-apart openings 282 formed therein and adjacent mounting holes 284 that facilitate connection of cable chain 264 to rear frame 268 at any of several locations and to allow more than one cable chain to be utilized with display stand 56. In the embodiment shown, there are six spaced-apart openings 282 and six corresponding sets of mounting holes 284 all spaced apart horizontally across rear frame 268, but other embodiments could include more or fewer connection locations spaced apart and arranged in a different manner and more than one cable chain. Adjustability and modularity provided by multiple connection locations enables the user to set up cable chain 264 at a location that is convenient for the size and configuration of the display monitors 70 (FIGS. 1 and 9) used with desk 50. Similarly, boom 122 and boom extension 124 include a multitude of threaded mounting holes 288 spaced apart along their length for selectively positioning cable management trays 260, cable chain 264, display mounting brackets 290, an optional display power strip 294, and other accessories at desired locations along the length of boom 122 and boom extension 124.

Figure 10:
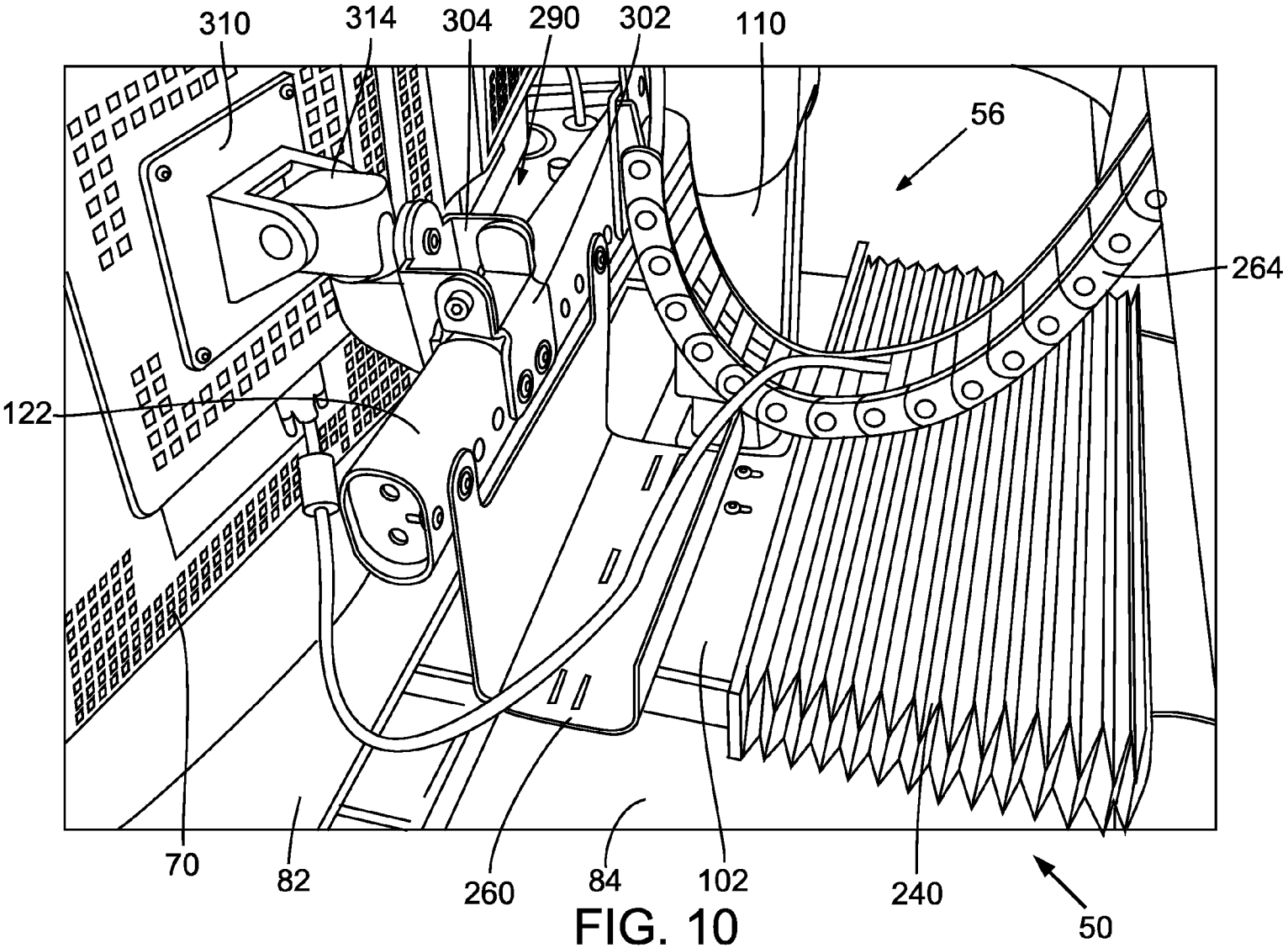
FIG. 10 is a right side rear upper view of the display stand of FIGS. 2-5 showing detail of adjustable mounting features and cable management features of the display stand.
Figure 11:
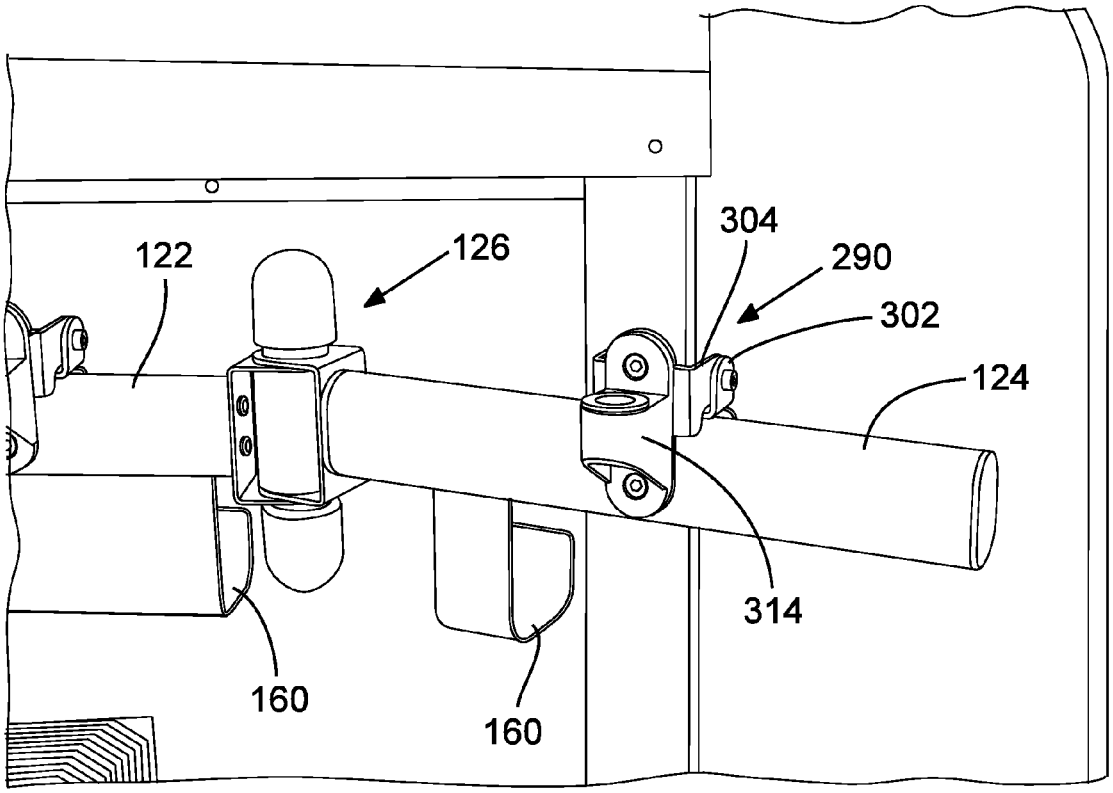
FIG. 11 is a front view of a boom extension arm of the display stand of FIG. 4.

As described above with reference to FIGS. 4 and 11, pivot joint 126 provides a passive safety feature that allows boom extension arm 124 to pivot in the event that a display monitor mounted thereon encounters an obstacle while adjusting the depth position of display stand 56. Turning now to FIGS. 10 and 11, a further passive safety feature is provided by display mounting brackets 290. Specifically, display mounting brackets 290 include a mounting base 302 bolted to mounting holes 288 and a rotatable hangar bracket 304 pinned or bolted to mounting base 302 and supported thereon for free rotation upwardly about a generally horizontal axis in the event that an obstacle is encountered by a display monitor mounted thereon while adjustably lowering the display stand 56. This may prevent vertical adjustment of the display monitor from crushing hands or damaging the display monitor. Video Electronics Standards Association (VESA) standard mounting brackets 310 are preferably attached to display mounting brackets 290 via rotation joints 314 allowing three rotational degrees of freedom. Rotation joints 314 allow a user to adjust the tilt, pan, and yaw of the display monitor while providing enough frictional resistance to hold an attached display monitor in a desired position.

As used herein, the term "desk" is intended to be broadly construed to include desks, tables, and other like devices including elevated work surfaces and a support base. Accordingly, references in the claims to "tables" and "table sections" should be construed to encompass work surfaces of tables and desks. It will be obvious to those having skill in the art that many changes may be made to the details of the above-described embodiments without departing from the underlying principles thereof. The scope of the present invention should, therefore, be determined only by the following claims.

The invention claimed is:

1. A table including an adjustable display stand, comprising:

a support platform having one edge and including an opening therein;

a sled movably mounted to the support platform for movement along a first path toward and away the edge to adjustably position the sled from a user of the table, the sled extending at least partly under the support platform;

an electronically-controllable sled drive operably interposed between the sled and the support platform for moving the sled relative to the support platform along the first path;

a mast supported on the sled and extending upwardly therefrom, the mast movable with the sled along the first path, at least a portion of the sled or the mast, or both, extending through the opening in the support platform for movement within the opening, the mast including a base member securely supported on the sled and a moving member movable upwardly relative to the base member along a second path transversely of the first path;

a display mount supported on the moving member of the mast and adapted for mounting a display monitor thereon; and an electronically-controllable mast drive operably interposed between the base member and moving member of the mast for driving the moving member relative to the base member to adjust a height position of the display mount above the support platform.

2. The table of claim 1, further comprising a user interface coupled to the mast drive and the sled drive for allowing a user to selectively adjust the position of the display mount.

3. The table of claim 2, wherein the user interface includes a first toggle switch for adjusting the sled and a second toggle switch for adjusting the mast.

4. The table of claim 2, wherein the user interface includes a controller, a memory for storing multiple user-defined positions of the display mount, and a keypad for instructing the controller to store the user-defined positions in the memory and for recalling the user-defined positions from memory, the controller operable to adjust the mast and the sled to move the display mount to a selected one of the user-defined positions when recalled via the keypad.

5. The table of claim 1, wherein the sled is slidably mounted on the support platform via a set of extension slides.

6. The table of claim 1, wherein the mast drive includes a mast drive motor mounted to an underside of the sled.

7. The table of claim 1, wherein the support platform is mounted on an adjustable base assembly, the base assembly driven for selectively raising and lowering the support platform and the display stand.

8. The table of claim 7, wherein the support platform is rotatably mounted on the base assembly and driven for selectively tilting the support platform and the display stand.

9. The table of claim 1, wherein the support platform includes:

a first table section positioned in front of the mast, at least a portion of which is open for use as a work surface; and a second table section in which the opening is formed.

10. The table of claim 1, wherein the display mount includes an elongate boom supported on the movable member of the mast and extending laterally therefrom, the boom including multiple mounting holes spaced apart along the boom to which display mounting brackets may be attached at selected positions along the boom for supporting multiple display monitors thereon in side-by-side relation.

11. The table of claim 1, further comprising a guard extending beneath the support platform at least partly around and in front of a path of the sled, the guard preventing the sled from hitting a user's knees when the sled is moved toward the user.

12. The table of claim 1, wherein at least a portion of the sled drive is located below the support platform.

13. The table of claim 1, further comprising:

a backlight for variably illuminating a region behind the display stand;

a photosensor mounted to the movable member of the mast via a flexible neck for positioning the photosensor at a desired position in front of a display monitor when mounted on the display stand, the photosensor thereby movable in tandem with the movable member of the mast and the sled to maintain the desired position of the photosensor relative to the display monitor; and an illumination control system coupled to the photosensor and the backlight for controlling luminous output of the backlight in response to changes in the display of the display monitor.

14. A desk-mountable adjustable display stand, comprising:

a sled including a mounting structure mountable to a support platform of a desk for sliding movement along a first path toward and away from an edge of the support platform to adjustably position the sled from a user of the desk;

a mast supported on the sled and extending upwardly from the sled, the mast including a base member attached to the sled and a moving member movable relative to the base member along a second path transversely to the first path;

a display mount supported on the moving member of the mast and adapted for mounting a display monitor thereon;

a mast drive coupled to the mast for driving the moving member along the second path, thereby adjusting a height position of the display mount;

a sled drive coupled to the sled for driving the sled along the first path relative to the support platform, thereby adjusting a depth position of the display mount with respect to the support platform; and a user interface for controlling the mast drive and the sled drive for adjusting the height and depth positions of the display mount.

15. The display stand of claim 14, further comprising a tray with a set of extension slides mounted thereon, the sled slidably mounted on the extension slides, the tray adapted to be attached to the support platform.

16. The display stand of claim 14, wherein the mast drive includes a mast drive motor mounted to an underside of the sled.

17. The display stand of claim 14, wherein the display mount includes an elongate boom supported on the movable member of the mast and extending laterally therefrom, the boom including multiple mounting holes spaced apart along the boom to which display mounting brackets may be attached at selected positions along the boom for supporting multiple display monitors thereon in side-by-side relation.

18. The display stand of claim 14, further comprising:

a first hinge interposed between the display mount and the mast for pivoting a display about a substantially horizontal axis; and a second hinge attached to the display mount for pivoting a portion of the display mount relative to the mast about a substantially vertical axis.

19. The display stand of claim 14, further comprising a controller coupled to the user interface, the sled drive and the mast drive, the controller including a processor and a memory operatively connected to the processor, the processor and memory cooperating for moving the sled and the moveable member of the mast to predefined positions.

20. The display stand of claim 14, wherein the display mount includes a hinged mounting bracket on which a display monitor may be supported, the mounting bracket movable to allow the display monitor to pivot relative to the mast in the event that the display monitor encounters an object when the moving member of the mast is moved toward the sled.

* * * * *